US009941062B2

(12) United States Patent
Yamada

(10) Patent No.: US 9,941,062 B2
(45) Date of Patent: Apr. 10, 2018

(54) KEY SWITCH STRUCTURE

(71) Applicant: Oki Electric Industry Co., Ltd., Tokyo (JP)

(72) Inventor: Shigeru Yamada, Tokyo (JP)

(73) Assignee: JIANGSU TRANSIMAGE TECHNOLOGY CO., LTD., Gaoyou, Jiangsu Province (CN)

( * ) Notice: Subject to any disclaimer, the term of this patent is extended or adjusted under 35 U.S.C. 154(b) by 0 days.

(21) Appl. No.: 15/112,695

(22) PCT Filed: Oct. 22, 2014

(86) PCT No.: PCT/JP2014/078107
§ 371 (c)(1),
(2) Date: Jul. 20, 2016

(87) PCT Pub. No.: WO2015/132999
PCT Pub. Date: Sep. 11, 2015

(65) Prior Publication Data

US 2016/0351350 A1 Dec. 1, 2016

(30) Foreign Application Priority Data

Mar. 4, 2014 (JP) ..... 2014-041917

(51) Int. Cl.
*H01H 13/14* (2006.01)
*H01H 3/12* (2006.01)

(52) U.S. Cl.
CPC ..... *H01H 3/125* (2013.01); *H01H 2219/03* (2013.01); *H01H 2219/062* (2013.01); *H01H 2221/07* (2013.01)

(58) Field of Classification Search
CPC .. H01H 13/83; H01H 2219/062; H01H 3/125; H01H 2219/06; H01H 13/023; H01H 13/702; H01H 2221/07; H01H 2219/014; H01H 2013/026
USPC ..... 200/5 A, 341, 344, 310–317; 362/23.03, 362/23.05, 84, 23.16, 612, 600, 611, 362/23.01, 615, 623
See application file for complete search history.

(56) References Cited

U.S. PATENT DOCUMENTS 5,397,867 A * 3/1995 Demeo ..... G02B 6/0043 200/311
2011/0155551 A1 6/2011 Yamada
2011/0297523 A1* 12/2011 Tsai ..... H01H 3/125 200/5 A
2013/0087440 A1* 4/2013 Huang ..... H01H 3/125 200/314

FOREIGN PATENT DOCUMENTS

CN 101051569 A 10/2007
CN 101752129 A 6/2010
(Continued)

*Primary Examiner* — Ahmed Saeed
(74) *Attorney, Agent, or Firm* — Rabin & Berdo, P.C.

(57) ABSTRACT

To provide a key switch structure where the outline of a key top becomes well-defined. A reflection sheet is adhered on top of a membrane sheet, so that light reflected by a back surface of a key top is reflected by the reflection sheet and emitted toward the outer side of the outer periphery of the key top. Because of this, the outer side of the key top is lighted up and the outline of the key top becomes well-defined.

6 Claims, 9 Drawing Sheets

(56) References Cited

FOREIGN PATENT DOCUMENTS

| | | | |
|---|---|---|---|
| JP | S63-037032 | U1 | 3/1988 |
| JP | H08-79354 | A | 3/1996 |
| JP | 2008-235065 | A | 10/2008 |
| JP | 2011-018484 | A | 1/2011 |
| JP | 2012-134182 | A | 7/2012 |
| KR | 2000-0006192 | A | 1/2000 |

* cited by examiner

KEY SWITCH STRUCTURE

TECHNICAL FIELD

The present invention relates to a key switch structure and relates to a key switch structure used in keyboards for information processing devices, measuring instruments, medical instruments, personal computers, etc.

BACKGROUND ART

In conventional keyboards, a key switch structure is known which, in order to light up a character or the like on a key top, projects light onto the back side of the key top from a light emitting portion of a back plate placed on the underside of the key top, to thereby light up a character or a symbol, for example, of a key switch (e.g., see JP-A No. 2008-235065 and JP-A No. 2011-18484).

This type of key switch structure is equipped with a link mechanism that supports the key top in such a way that the key top can be pressed, and the link mechanism is supported by supports members that are disposed on the back plate and comprise a material that transmits light.

SUMMARY OF INVENTION

Technical Problem

In this connection, some of the light emitted from the back plate is reflected by the back surface (undersurface) of the key top, travels through the space between the key top and the back plate, and leaks out from the outer periphery of the key top. For this reason, in a case where the environment in which the keyboard is located is dark, the periphery of the key top appears bright.

However, because, for example, the link mechanism that supports the key top is placed between the key top and the back plate, the quantity of light in the sections that fall in the shadow of the link mechanism and so forth is insufficient so that there are also dark sections around the key top, and thus there has been room for improvement.

In consideration of the above-described circumstances, it is an object of the present invention to provide a key switch structure that emits light from the periphery of the key top so that the outline of the key top becomes well-defined.

Solution to Problem

A key switch structure of a first aspect of the present invention comprises: a key top in which is formed a light transmitting portion that transmits light; a link mechanism that supports the key top in such a way that the key top can be pressed down; a back plate that is equipped, under the key top, with a light emitting portion that emits light toward a back surface of the key top; support members that are disposed on the back plate and support the link mechanism; a membrane sheet that is placed on top of the back plate and is equipped with contact portions between which an electrical connection is established as a result of the key top being pressed down; an elastic member that is equipped with a pressing portion that causes an electrical connection to be established between the contact portions, the elastic member urging the key top in a direction away from the contact portions; holes that are formed in the membrane sheet, allow the light emitted from the light emitting portion to travel through them, and expose the support members to the key top side; and a first reflection layer that is disposed on the membrane sheet, receives the light reflected by the back surface of the key top, and reflects the light from the outer periphery of the key top toward the outer side of the key top.

Next, the action of the key switch structure of the first aspect of the present invention will be described.

In the key switch structure of the first aspect of the present invention, when the user presses down the key top counter to the urging force of the elastic member, the elastic member becomes compressed and the pressing portion causes an electrical connection to be established between the contact portions.

The light emitted from the light emitting portion of the back plate is emitted via the holes in the membrane sheet toward the key top side and projected onto the back surface of the key top. Additionally, the light transmitted through the light transmitting portion of the key top is emitted toward the outer side of the key top. In the key switch structure of the first aspect of the present invention, the light transmitting portion of the key top can be lighted up in this way.

Furthermore, the light projected onto the back surface of the key top is reflected by the back surface of the key top, some of the reflected light is projected onto the first reflection layer, and the first reflection layer reflects the projected light from the outer periphery of the key top toward the outer side of the key top. For this reason, the periphery of the key top appears bright.

The first reflection layer efficiently reflects the projected light from the outer periphery of the key top toward the outer side of the key top, so the periphery of the key top appears bright, even in those sections that fall in the shadow of the link mechanism and lack a sufficient quantity of light, compared to a case where the first reflection layer is not disposed.

A second aspect of the present invention is the key switch structure of the first aspect, wherein the first reflection layer is disposed on an outer side of the outer periphery of the key top when the key top is seen in a plan view.

In the key switch structure of the second aspect of the present invention, the first reflection layer is disposed on the outer side of the outer periphery of the key top when the key top is seen in a plan view, so the light can be reflected on the outer side of the outer periphery of the key top.

A third aspect of the present invention is the key switch structure of the second aspect, wherein the first reflection layer is disposed on the inner side of the outer periphery of the key top when the key top is seen in a plan view.

In the key top structure of the third aspect of the present invention, the first reflection layer is disposed on the inner side of the outer periphery of the key top when the key top is seen in a plan view, so the light reflected by the back surface of the key top can be reflected toward the back surface of the key top. Because the light can be multiply reflected between the back surface of the key top and the first reflection layer placed on the inner side of the outer periphery of the key top, the light quantity of the light projected onto the light transmitting portion of the key top or the light emitted toward the outer side of the outer periphery of the key top can be increased.

A fourth aspect of the present invention is the key switch structure of the first aspect, wherein a second reflection layer is disposed on the back surface of the key top.

In the key switch structure of the fourth aspect of the present invention, the second reflection layer that reflects the light emitted from the light emitting portion is disposed on the back surface of the key top, so the light emitted from the light emitting portion can be efficiently reflected toward the first reflection layer by the second reflection layer. For this reason, the light quantity of the light reflected by the first reflection layer increases.

A fifth aspect of the present invention is the key switch structure of any one of the first to fourth aspects, wherein a plurality of the key tops are plurally disposed spaced apart from each other on the back plate, and a frame is placed between the key top and the key top.

In the key switch structure of the fifth aspect of the present invention, the frame is placed between the key top and the key top. For this reason, some of the first reflection layer is covered by the frame, but the first reflection layer between the key top and the frame appears bright in the shape of a frame on the key top outer peripheral side of the outer periphery of the key top.

A sixth aspect of the present invention is the key switch structure of the fifth aspect, wherein the reflectance of the first reflection layer is higher than that of the frame.

In the key switch structure of the sixth aspect of the present invention, the reflectance of the first reflection layer is higher than that of the frame, so the first reflection layer between the key top and the frame appears bright and the frame appears dark.

A seventh aspect of the present invention is the key switch structure of any one of the first to sixth aspects, wherein the first reflection layer is an ink layer printed on a front surface of the membrane sheet, a reflection sheet adhered to the membrane sheet, or a reflective sheet disposed on the uppermost layer of the membrane sheet comprising a plurality of laminated sheets.

In the key switch structure of the seventh aspect of the present invention, in a case where the first reflection layer is an ink layer printed on the front surface of the membrane sheet, the light is reflected by the ink layer.

In a case where the first reflection layer is a reflection sheet adhered to the membrane sheet, the light is reflected by the reflection sheet.

Furthermore, in a case where the first reflection layer is a reflective sheet in the membrane sheet comprising a plurality of laminated sheets, the light is reflected by the reflective sheet.

Advantageous Effects of Invention

The key switch structure of the first aspect of the present invention is given the above-described configuration, so it has the superior effect that the outline of the key top becomes well-defined.

The key switch structure of the second aspect of the present invention is given the above-described configuration, so the area all around the outer side of the outer periphery of the key top appears bright when the key top is seen in a plan view.

The key switch structure of the third aspect of the present invention is given the above-described configuration, so the light projecting portion and the outer peripheral side of the key top can be more brightly lighted up.

The key switch structure of the fourth aspect of the present invention is given the above-described configuration, so the outer peripheral side of the key top can be more brightly lighted up.

The key switch structure of the fifth aspect of the present invention is given the above-described configuration, so the space between the key top and the frame appears bright in the shape of a frame and the outline of the section that appears bright becomes well-defined.

The key switch structure of the sixth aspect of the present invention is given the above-described configuration, so the space between the key top and the frame certainly appears brighter than the frame.

The key switch structure of the seventh aspect of the present invention is given the above-described configuration, so the first reflection layer can be configured by a simple configuration.

DESCRIPTION OF EMBODIMENTS

First Embodiment

Figure 1:
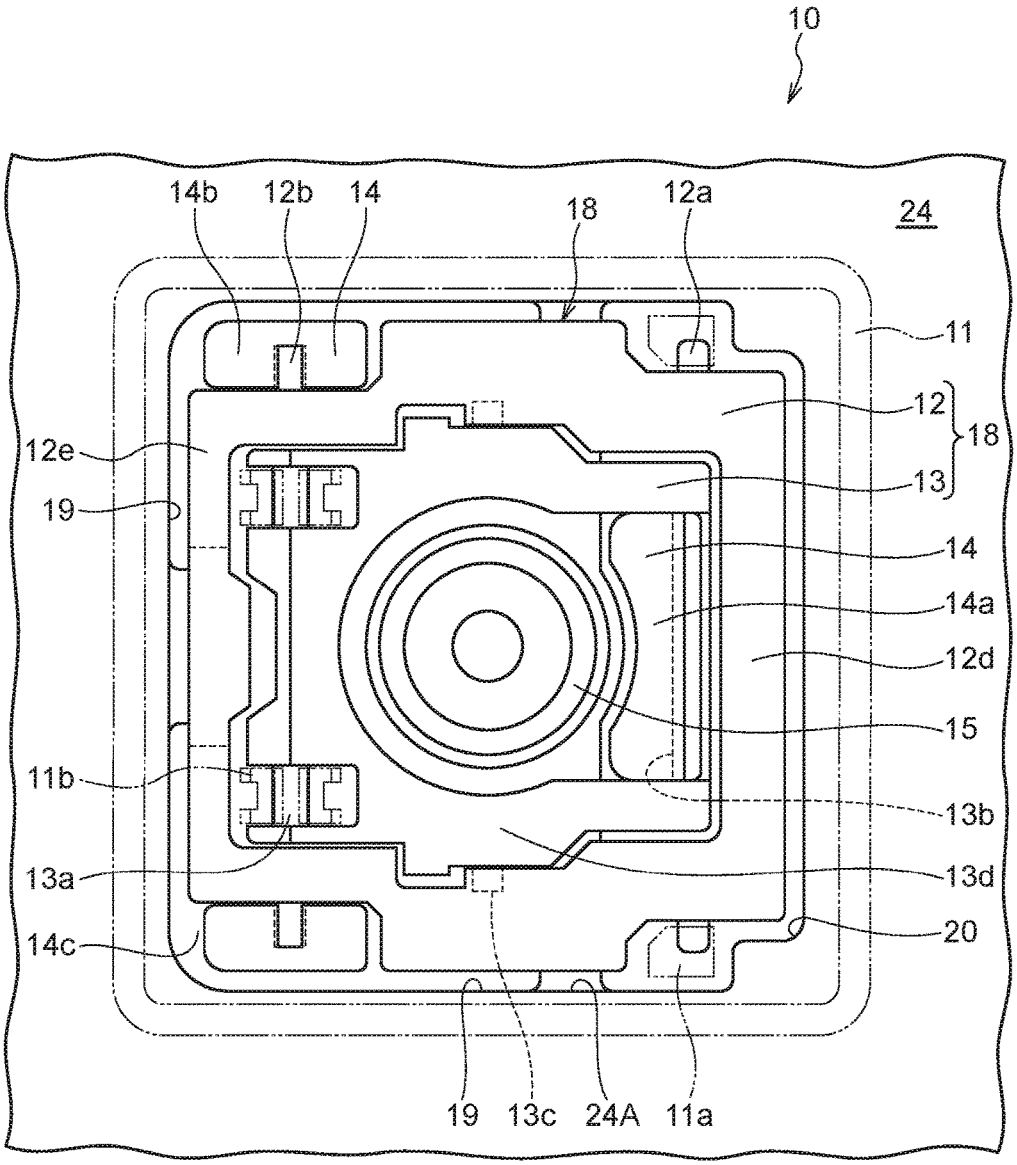
FIG. 1 is a plan view, from which a key top has been removed, showing a key switch structure pertaining to a first embodiment of the present invention.
Figure 2:
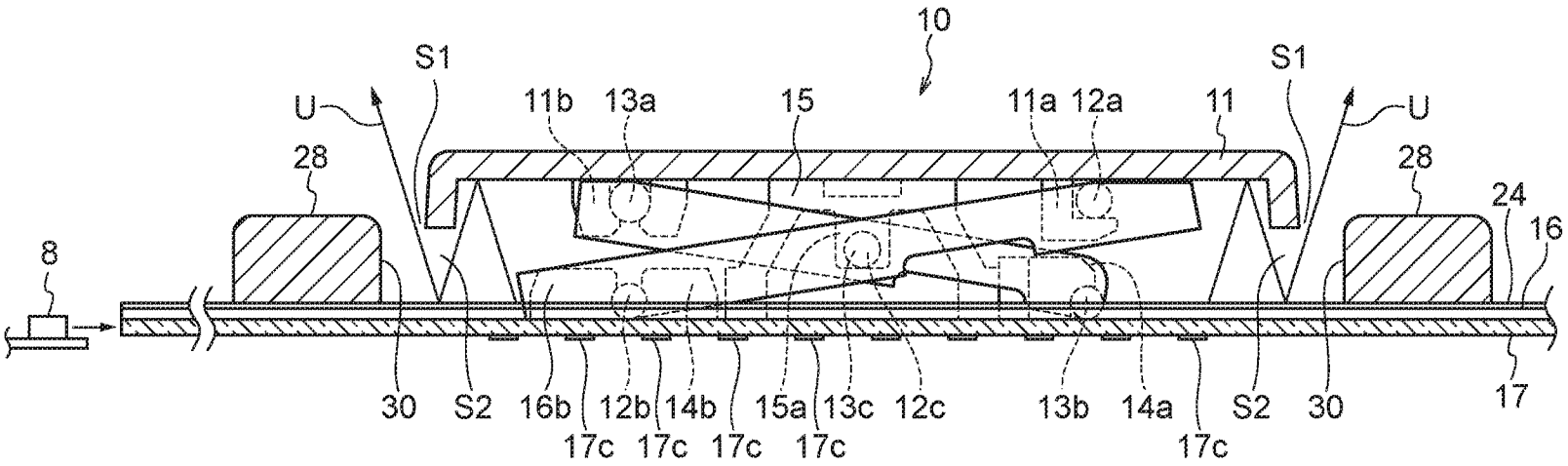
FIG. 2 is a longitudinal sectional view showing the key switch structure pertaining to the first embodiment.

A first embodiment of a key switch structure 10 according to the present invention will be described below with reference to the drawings. As shown in FIG. 1 and FIG. 2, the key switch structure of the present embodiment is configured to include a key top 11, a link mechanism 18 configured to include a first link member 12 and a second link member 13 that support the key top 11, a rubber dome 15 serving as an elastic member, a membrane sheet 16, a back plate 17, and holders 14 comprising a pair of first holders 14*b* and a second holder 14*a* that support the link mechanism 18 on the back plate 17.

The back plate 17 is a plate made of a transparent or other material whose light transmissivity is high (e.g., synthetic resin). An LED 8 is disposed opposing one side surface of the back plate 17. The light emitted from the LED 8 travels while bending through the inside of the back plate 17, is reflected by plural reflection portions 17*c* formed directly under the key top 11, and is emitted toward the key top side (see arrows U in FIG. 3). It should be noted that the LED 8 in the present embodiment emits white light, for example. Furthermore, a light sensor detects the brightness of the area around the key switch structure 10, and the LED 8 is lighted in a case where the brightness of the surrounding area is dark.

Figure 3:
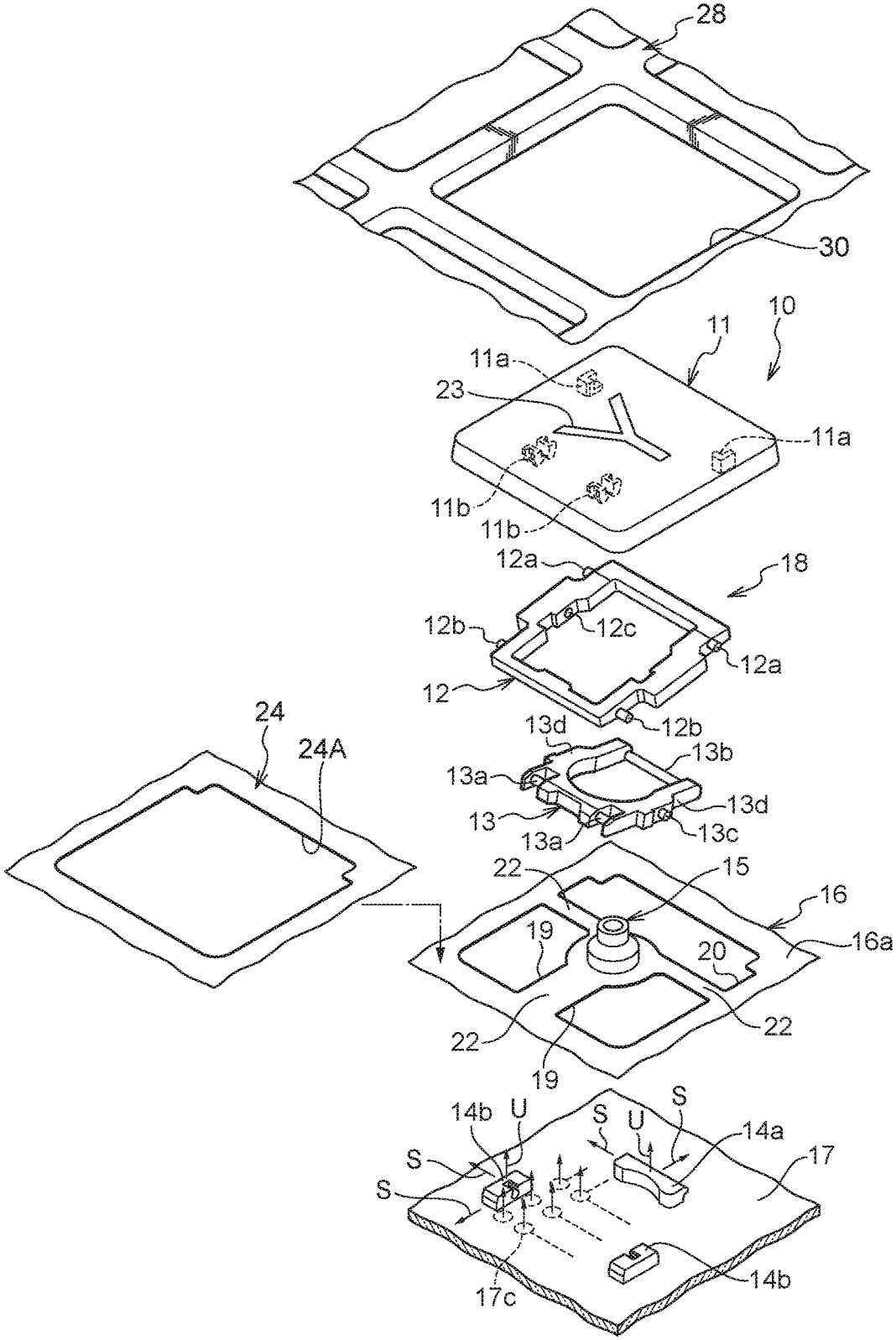
FIG. 3 is an exploded perspective view showing the key switch structure pertaining to the first embodiment.

As shown in FIG. 3, the reflection portions 17*c* are round dots printed in white ink, for example, but they may also be dimples formed by processing part of the back plate 17 in recessed shapes. Furthermore, it suffices for the reflection portions 17*c* to be formed at least under a later-described light transmitting portion 23 such as a character or a symbol, for example, formed in the key top 11, and the number and placement of the reflection portions 17*c* are appropriately changed depending on the shape and size, for example, of the light transmitting portion 23.

As shown in FIG. 2 and FIG. 3, the pair of first holders 14*b* and the second holder 14*a* that support the link mechanism 18 are placed on the back plate 17 in positions opposing the key top 11. The first holders 14*b* and the second holder 14*a* are made of a material such as a transparent, semitransparent, milky-white, or other synthetic resin whose light transmissivity is high.

Figure 4:
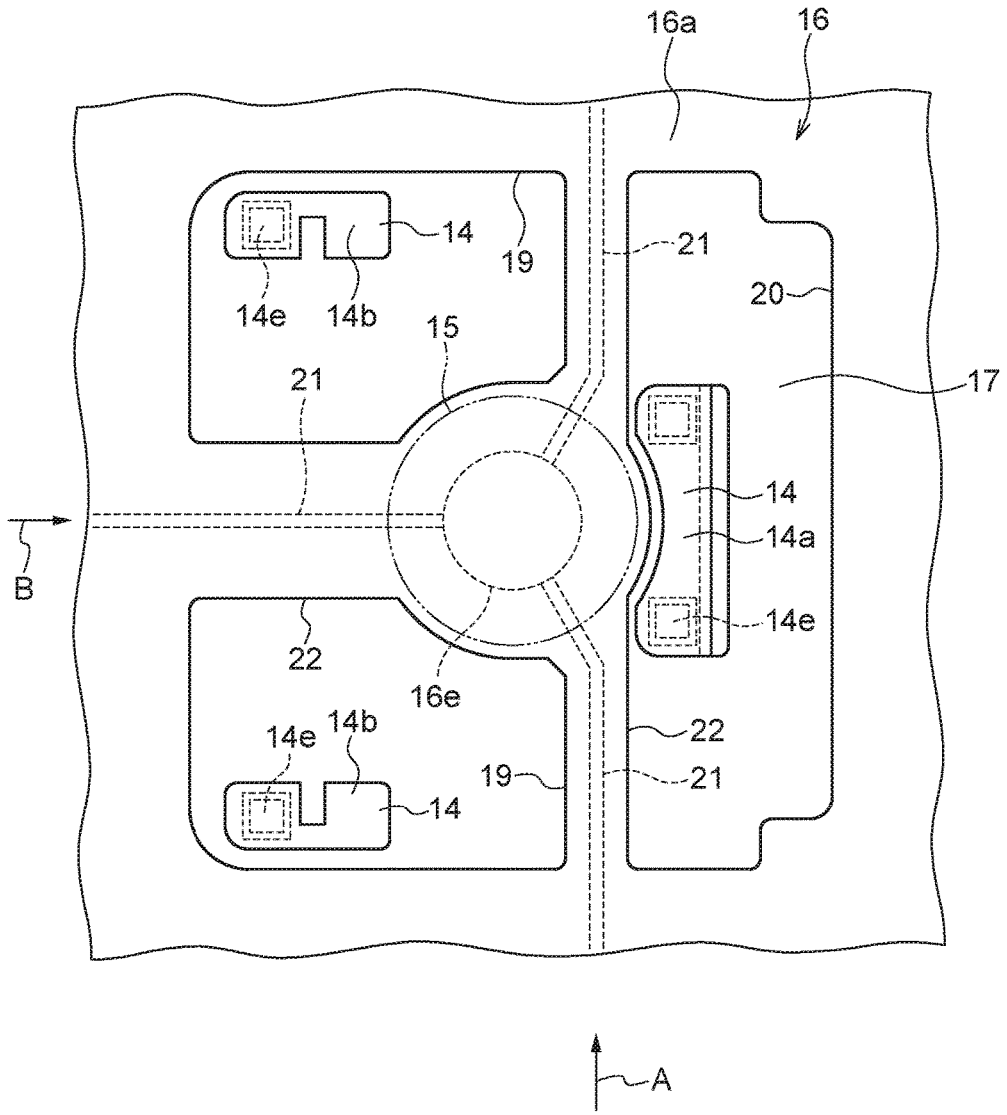
FIG. 4 is a plan view showing a back plate, a membrane sheet, first holders, and a second holder from which a reflection sheet has been excluded.
Figure 5:
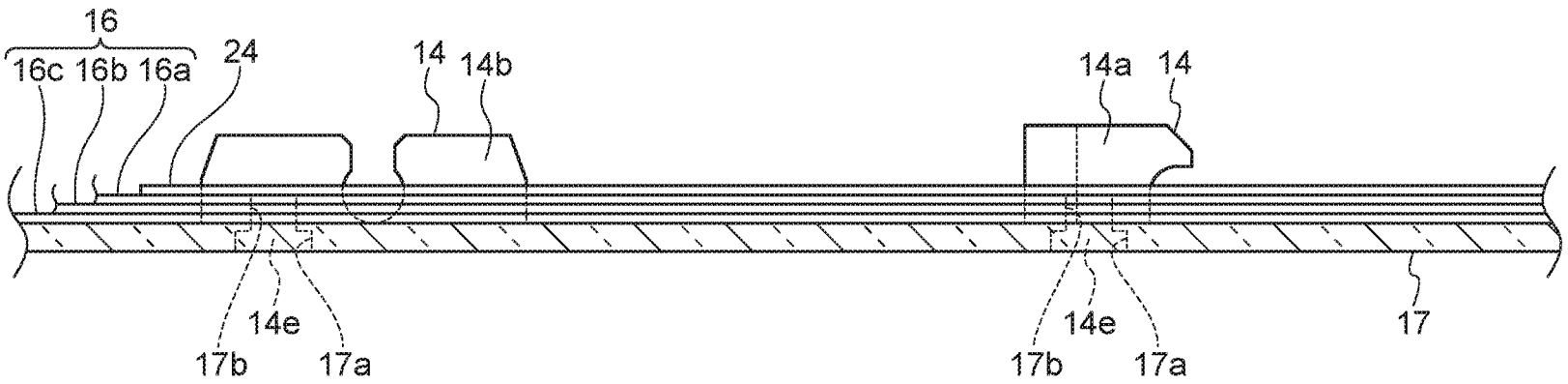
FIG. 5 is a side view showing the back plate, the membrane sheet, the reflection sheet, the first holders, and the second holder as seen from the direction of arrow A in FIG. 4.
Figure 6:
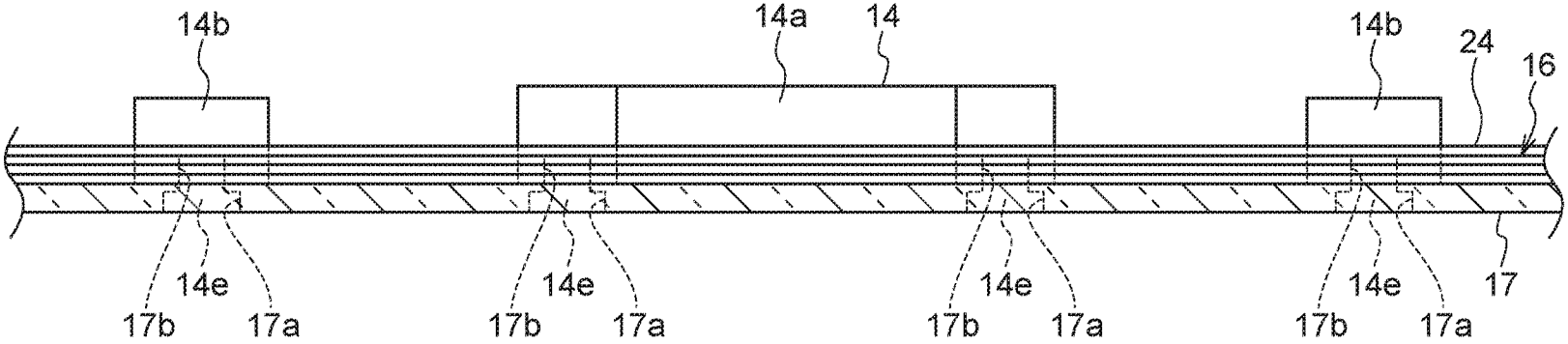
FIG. 6 is a side view showing the back plate, the membrane sheet, the reflection sheet, the first holders, and the second holder as seen from the direction of arrow B in FIG. 4.

As shown in FIG. 4 to FIG. 6, fixing pins 14*e* are disposed on the lower end surfaces (the end surfaces on the back plate 17 side) of the first holders 14*b*, and the fixing pins 14*e* are inserted into attachment holes 17*b* formed in the back plate 17. Recessed portions (countersinks) 17*a* are formed around the undersurface sides of the attachment holes 17*b*, and the first holders 14*b* are fixed to the back plate 17 by heating the distal ends of the fixing pins 14*e* to cause them to flatly deform inside the recessed portions 17*a*. Furthermore, the first holders 14*b* can also be fixed to the back plate 17 by insert molding.

Furthermore, fixing pins 14*e* are also disposed on the lower end surface on the back plate 17 side of the second holder 14*a*, the fixing pins 14*e* are also inserted in attachment holes 17*b* formed in the back plate 17, and the second holder 14*a* is fixed to the back plate 17 by heating the distal ends of the fixing pins 14*e* to cause them to flatly deform inside the recessed portions 17*a*. Furthermore, the second holder 14*a* can also be fixed to the back plate 17 by insert molding.

(Membrane Sheet)

As shown in FIG. 4 and FIG. 5, the membrane sheet 16 is given a configuration where a spacer sheet 16*b* is sandwiched between 2 sheets—that is, an upper sheet 16*a* and a lower sheet 16*c*—in which a wiring pattern 21 is printed, and these are adhered to each other. Each sheet is made of a flexible synthetic resin material that transmits light. The lower sheet 16*c* of the membrane sheet 16 is placed on top of the back plate 17.

As shown in FIG. 3 and FIG. 4, the membrane sheet 16 is equipped with contact portions 16*e* directly under the central portion of the key top 11. The contact portions 16*e* comprise electrical contacts that are placed in opposing places in the upper sheet 16*a* and the lower sheet 16*c*, which are adhered to each other across the spacer sheet 16*b* of the membrane sheet 16, and when the contact portions 16*e* of the membrane sheet 16 are pressed in the thickness direction, the electrical contact in the upper sheet 16*a* and the electrical contact in the lower sheet 16*c* come into contact with each other, an electrical connection is established, and the switch becomes closed.

When the key top 11 stops being pressed down, the constituent parts return to their original state due to the restoring force (elasticity) of the rubber dome 15 and the membrane sheet 16, the electrical contact in the upper sheet 16*a* and the electrical contact in the lower sheet 16*c* move away from each other, and the electrical contact becomes broken, so the switch becomes open.

As shown in FIG. 3 to FIG. 5, the first holders 14*b* and the second holder 14*a* project from holes 19 and 20, respectively, disposed in the membrane sheet 16 in accordance with the positions of the first holders 14*b* and the second holder 14*a*.

As shown in FIG. 1, when the key top 11 is seen in a plan view, the holes 19 and 20 are formed on the inner side of the outer peripheral edge (outer peripheral portion) of the key top 11. The holes 19 and 20 can be formed by stamping.

As shown in FIG. 3 and FIG. 4, the rubber dome 15 is fixed by an adhesive, for example, to the upper sheet 16*a* of the membrane sheet 16, on the upper side of the contact portions 16*e*. As shown in FIG. 2, the rubber dome 15 is formed in a substantially cup-like shape using rubber, for example, as its material, and a contact press-down portion 15*a* is formed in the central portion of the inner surface of the rubber dome 15 so as to project toward the membrane sheet 16. It should be noted that the rubber dome 15 of the present embodiment is semi-transparent so that light is transmitted through it.

When the key top 11 is pressed down, the key top 11 moves toward, while remaining parallel to, the membrane sheet 16 (the back plate 17) because of the action of the later-described link mechanism 18, the rubber dome 15 becomes compressively deformed, and the contact press-down portion 15*a* formed inside the rubber dome 15 comes into contact with the contact portions 16*e* of the membrane sheet 16 and presses the contact portions 16*e* so that the switch becomes closed.

When the key top 11 stops being pressed down, the constituent parts return to their original state due to the restoring force (elasticity) of the rubber dome 15 and the membrane sheet 16, the contact portions 16*e* of the membrane sheet 16 lose contact with each other, and the electrical contact becomes broken, so the switch becomes open.

As shown in FIG. 3 and FIG. 4, the section of the upper sheet 16*a* between the hole 19 and the hole 19 and the section of the upper sheet 16*a* between the holes 19 and the hole 20 are wiring portions 22 in which is formed the wiring pattern 21 connected to the electrical contacts, and on top of the upper sheet 16*a* a reflection sheet 24 whose light reflectance is higher than that of the upper sheet 16*a* is adhered to the entire front surface (the upper surface on the key switch side) excluding the wiring portions 22. It should be noted that an opening 24A for exposing the holes 19, the hole 20, and the wiring portions 22 is formed in the reflection sheet 24.

The reflection sheet 24 of the present embodiment is a white, pressure-sensitive adhesive sheet comprising a synthetic resin, for example. The synthetic resin configuring the reflection sheet 24 may be white, or a white ink may be applied by printing, for example, to the sheet front surface of the reflection sheet 24. It should be noted that the reflection sheet 24 of the present embodiment does not transmit light. In the present embodiment, the holes 19, the hole 20, and the wiring portions 22 that can be seen through the opening 24A in the reflection sheet 24 are a light transmitting portion that can transmit, to the key top 11 side, the light emitted from the back plate 17, and the light emitted from the back plate 17 is emitted via the light transmitting portion and the opening 24A toward the back surface of the key top 11. It should be noted that, as shown in FIG. 1 and FIG. 3, the size of the opening 24A is smaller than the size of the key top 11, and when the key top 11 is seen in a plan view, the opening 24A is placed on the inner side of the outer peripheral edge of the key top 11. That is, when the key top 11 is seen in a plan view, the reflection sheet 24 is placed on the inner side of the outer peripheral edge of the key top 11.

(Key Top)

As shown in FIG. 1 and FIG. 3, sliding pin support portions 11*a*, which support sliding pins 12*a* disposed on the other end side of the first link member 12 in such a way that the sliding pins 12*a* are rotatable and capable of translational movement (motion) in the horizontal direction (a direction along the back surface of the key top 11), and rotational support portions 11*b*, which rotatably support rotating pins 13*a* disposed on the one end side of the second link member 13, are disposed on the back side (the side opposing the back plate 17) of the key top 11.

The key top 11 is made of a transparent or semitransparent (e.g., milky-white) synthetic resin. Monochrome or polychrome paint adjusted to control the transmission of light is applied to the front surface of the key top 11, and some of the paint is removed by laser marking, for example, in the shape of a character or a symbol, so that a light transmitting portion 23 that is an outline character (or an outline symbol) such as shown in FIG. 3 is formed. It should be noted that the light transmitting portion 23 includes all characters, symbols, numerical values, and so forth ordinarily appearing on the front surface of the key top 11.

(Link Mechanism)

As shown in FIG. 1 to FIG. 3, on the second link member 13, which is formed in the shape of a frame so that the rubber dome 15 goes through its center, link rotating shafts 13*c* that project outward are disposed in the vicinities of the centers of opposing two sides 13*d*, and a sliding pin 13*b* is disposed so as to couple together the other end sides of the opposing two sides 13*d*.

The sliding pin 13*b* of the second link member 13 is inserted into and held in the first holders 14*b* of the back plate 17 in such a way that the sliding pin 13*b* is rotatable and capable of translational movement in the horizontal direction (a direction along the front surface of the back plate 17), and rotating pins 12*b* disposed on the one end side of the first link member 12 are rotatably held in the second holder 14*a* of the back plate 17.

The second link member 13 and the first link member 12 have a nested structure where the second link member 13 fits inside the first link member 12, and the pantograph link mechanism 18 is configured by the second link member 13 and the first link member 12.

The link rotating shafts 13*c* of the second link member 13 fit into shaft holes 12*c* disposed in the frame inner peripheral surface side of the first link member 12, and the first link member 12 and the second link member 13 are put together in such a way that they are rotatable using the link rotating shafts 13*c* as an axis.

Because of this, when the key top 11 has been pressed down, the rotatably supported rotating pins 13*a* and rotating pins 12*b* only rotate in place without changing their positions relative to the key top 11 and the back plate 17, but the sliding pin 13*b* and the sliding pins 12*a* slide on the back plate 17 and the back side of the key top 11 as the key top 11 is pressed down.

The first link member 12 and the second link member 13 are both made of a transparent or semitransparent (e.g., milky-white) synthetic resin that transmits light.

As shown in FIG. 2 and FIG. 3, an upper cover 28 covers the membrane sheet 16 of the present embodiment. An opening 30 for exposing the key top 11 is formed in the upper cover 28. The size of the opening 30 is formed larger than the size of the key top 11, and a space S1 is disposed between the outer periphery of the key top 11 and the opening 30. For this reason, when the key top 11 is seen in a plan view, the reflection sheet 24 appears in the shape of a frame via the space S1.

The light reflectance (the brightness of the light) of the reflection sheet 24 of the present embodiment is set greater than that of the upper surface of the membrane sheet 16 (the upper sheet 16*a*), the key top 11, and the upper cover 28. For example, in a case where the color of the key top 11 and the upper cover 28 is black, red, blue, green, purple, orange, or pink, for example, it is preferred that the color of the reflection sheet 24 be white, silver, or pearl white, for example. Furthermore, in a case where the color of the key top 11 and the upper cover 28 is silver, it is preferred that the reflection sheet 24 be white or pearl white, for example. It should be noted that the reflection sheet 24 may also be a fluorescent color.

(Operation)

In the key switch structure 10 of the present embodiment, when a user presses down the key top 11, the key top 11 moves toward, while remaining parallel to, the membrane sheet 16 (the back plate 17) because of the action of the link mechanism 18, the key top 11 compressively deforms the rubber dome 15, and the contact press-down portion 15*a* presses the contact portions 16*e* of the membrane sheet 16 so that the switch becomes closed.

Furthermore, when the user removes his/her hand from the key top 11, the key top 11 moves in the direction away from, while remaining parallel to, the membrane sheet 16 (the back plate 17) because of the action of the rubber dome 15 and the link mechanism 18 and returns to its original height, and the contact press-down portion 15*a* moves away from the contact portions 16*e* of the membrane sheet 16 so that the switch becomes open (see FIG. 2).

When the LED 8 lights up, the light emitted from the LED 8 travels while bending through the inside of the back plate 17, is reflected by the reflection portions 17*c* formed directly under the key top 11, and is emitted toward the key top side (see arrows U in FIG. 3). The light emitted from the back plate 17 toward the key top 11 side travels through the holes 19 and the hole 20 and is also transmitted through the wiring portions 22, the first holders 14*b*, the second holder 14*a*, the first link member 12, the second link member 13, and the rubber dome 15, reaches the back surface of the key top 11, is transmitted through the key top 11, and is emitted in the key top upward direction from the light transmitting portion 23 such as a character or a symbol, for example. Because of this, the light transmitting portion 23 such as a character or a symbol, for example, in the key top 11 can be lighted up, and in a case where the surrounding environment is dark, the light transmitting portion 23 such as a character or a symbol, for example, appears bright.

In this connection, the light emitted from the back plate 17 toward the back surface of the key top 11 is reflected in various directions by the back surface of the key top 11—specifically in the downward direction of the key top 11 and in obliquely downward directions of the key top 11—so that some of the light reflected by the back surface of the key top 11 is emitted toward the reflection sheet 24. Some of the light projected onto the reflection sheet 24 is emitted toward the outer side of the outer periphery of the key top 11 via a space S2 between the key top 11 and the membrane sheet 16 (see arrows U in FIG. 2), while some of the light is emitted toward the back surface of the key top 11.

The light emitted toward the outer side of the outer periphery of the key top 11 is diffused and reflected by the white reflection sheet 24, so in a case where the surrounding environment is dark, the periphery of the key top 11 appears whitely bright.

In this connection, in a case where the reflection sheet 24 is not disposed so that, for example, the front surface of the membrane sheet 16 is a dark color and not white, the light reflectance becomes lower (i.e., the percentage at which light is absorbed becomes greater). There is a case where the light reflected by the back surface of the key top 11 is directly projected onto the front surface of the membrane sheet 16 and a case where the light reflected by the back surface of the key top 11 is transmitted through the link mechanism 18 and projected onto the front surface of the membrane sheet 16, and in the latter case the light projected onto the front surface of the membrane sheet 16 is weaker compared to the former case. For this reason, in the front surface of the membrane sheet 16, the sections onto which the light reflected by the back surface of the key top is directly projected appear bright, but weak light is projected onto the sections onto which the light transmitted through the link mechanism 18, the holders 14, and so forth is projected, so there are cases where they do not appear bright to the eye.

In the present embodiment, the white reflection sheet 24 whose reflectance is high is adhered to the front surface of the membrane sheet 16, so even the sections on which the weak light transmitted through the link mechanism 18, the holders 14, and so forth is projected appear distinctly bright, and the area all around the outer side of the outer periphery of the key top 11 appears bright. Because of this, the outer edge (outline) of the key top 11 can be made to appear well-defined, and visibility is improved.

Figure 7:
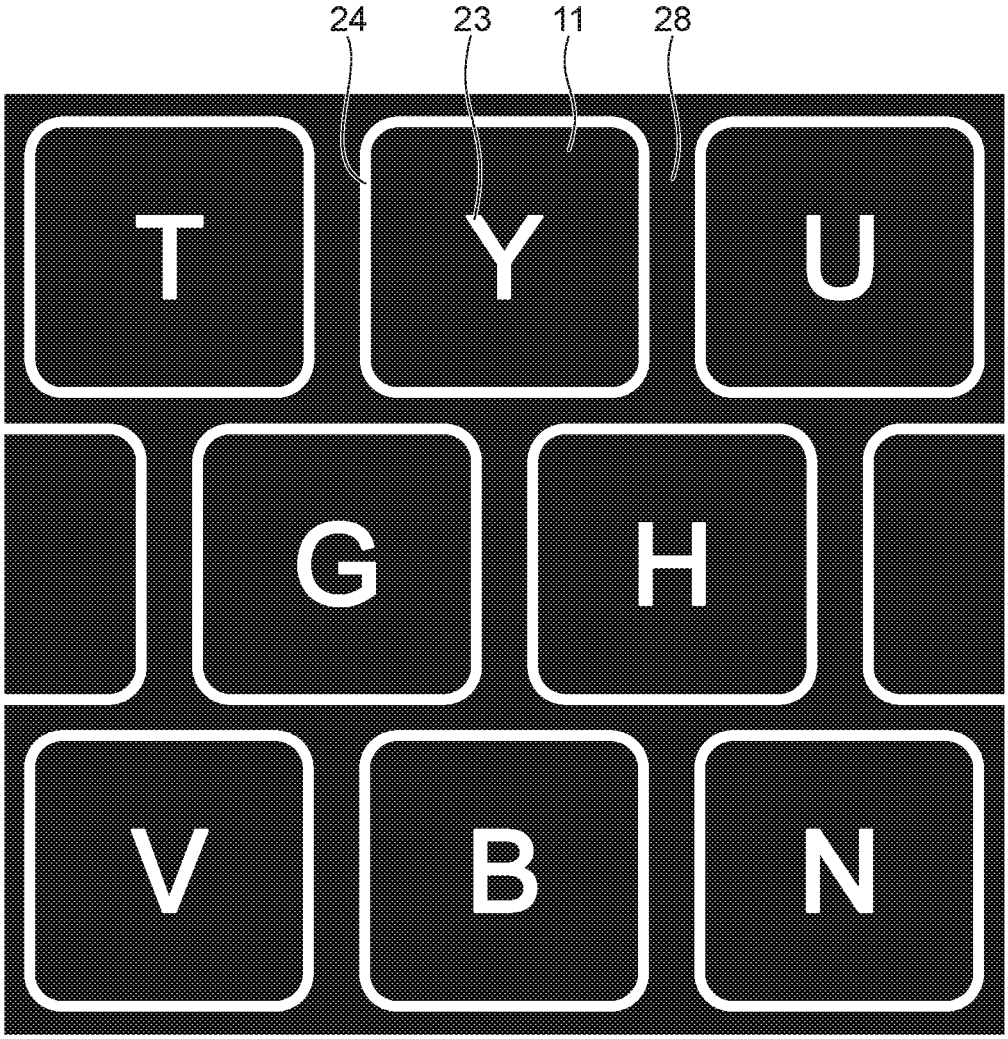
FIG. 7 is a plan view showing the outer peripheral side of the key top being lighted up in the key switch structure pertaining to the first embodiment.

Moreover, in the key switch structure 10 of the present embodiment, the upper cover 28 is disposed surrounding the outer periphery of the key top 11, and the space S1 is disposed between the key top 11 and the upper cover 28, so in an environment where the surroundings are dark, as shown in FIG. 7, the bright section of the reflection sheet 24 (the white section in FIG. 7) appears in the shape of a frame with a distinct outline. It should be noted that FIG. 7 shows an example of the key switch structure 10 where the key top 11 and the upper cover 28 are black and the reflection sheet 24 is white, but the key top 11, the upper cover 28, and the reflection sheet 24 may of course also be other colors.

In the key switch structure 10 of the present embodiment, the reflection sheet 24 enters the key top inner side of the outer periphery of the key top 11, so the light emitted through the opening 24A is multiply reflected between the back surface of the key top 11 and the reflection sheet 24 entering the inner side of the outer periphery of the key top 11, and the light quantity of the light projected onto the light transmitting portion 23 increases, so the light transmitting portion 23 can be more brightly lighted up.

The key switch structure 10 of the present embodiment has a configuration where the reflection sheet 24 is adhered to the front surface of the membrane sheet 16, but the present invention is not limited to this; for example, the front surface of the upper sheet 16*a* may also be painted white, for example, by printing, for example, or the upper sheet 16*a* itself of the membrane sheet 16 may also be a reflective sheet whose reflectance is high and which is colored white, for example. By using the upper sheet 16*a* colored white, for example, the reflection sheet 24 that is a part separate from the membrane sheet 16 becomes unnecessary.

Second Embodiment

In the present embodiment, although it is not shown in the drawings, the entire back surface of the key top 11 excluding the light transmitting portion 23 is painted white by printing, for example. For this reason, the light reflectance of the back surface of the key top 11 becomes higher, the light quantity of light projected toward the reflecting sheet 24 can be increased, and the outer peripheral side of the key top 11 can be made to appear brighter.

Furthermore, the light is multiply reflected between the back plate 17 and the back surface of the key top 11 whose light reflectance has become higher, so the light quantity of the light projected onto the light transmitting portion 23 of the key top 11 increases and the light transmitting portion 23 can be more brightly lighted up.

It should be noted that, like the reflection sheet 24, the back surface of the key top 11 is not limited to being white and it suffices for the back surface of the key top 11 to be a color whose reflectance is high, such as silver or pearl white, for example. Furthermore, the key top 11 may also be given a configuration where fine dimples and bumps are formed in the back surface of the key top 11 so that the light is diffused and reflected by the dimples and bumps.

Third Embodiment

Figure 8:
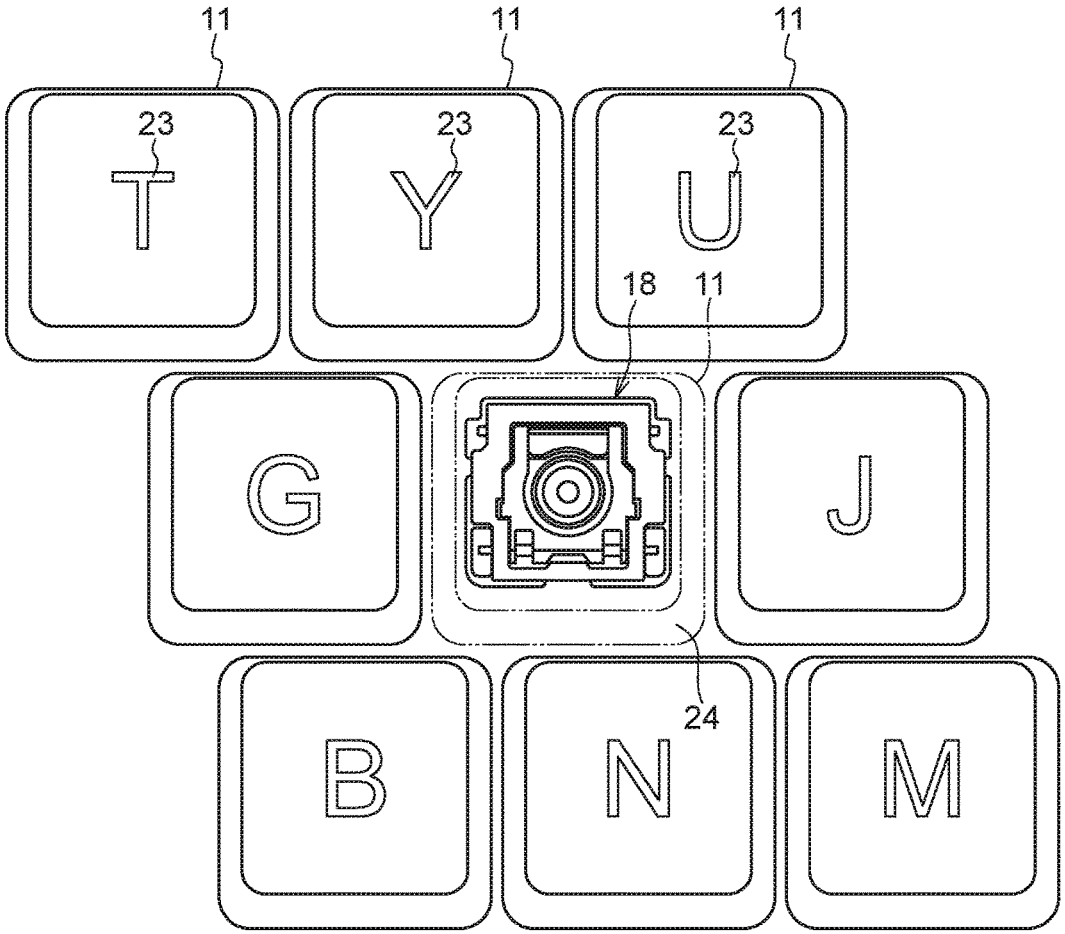
FIG. 8 is a plan view showing a key switch structure pertaining to a second embodiment.
Figure 9:
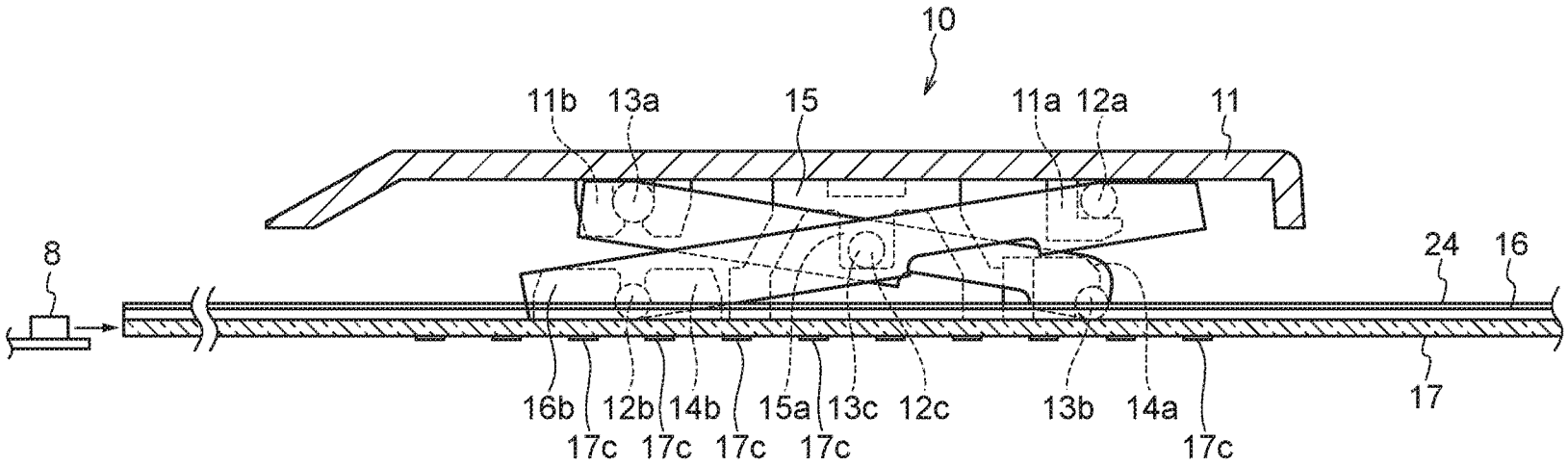
FIG. 9 is a longitudinal sectional view showing the key switch structure pertaining to the second embodiment.

In the embodiment described above, the upper cover 28 is disposed in the key switch structure 10, but as shown in FIG. 8 and FIG. 9, the key switch structure 10 may also have a configuration where the upper cover 28 is not disposed. In the key switch structure 10 of the present embodiment, a space is formed between the key top 11 and the key top 11, and the reflection sheet 24 appears bright from this space.

Working examples of the present invention have been described above, but the present invention is in no way limited to the above-described working examples and, it goes without saying, can be implemented in a variety of ways without departing from the spirit of the present invention.

The disclosure of Japanese Patent Application No. 2014-041917 filed on Mar. 4, 2014 is incorporated in its entirety herein by reference.

The invention claimed is:

1. A key switch structure, comprising:

a key top in which is formed a light transmitting portion that transmits light;

a link mechanism that supports the key top in such a way that the key top can be pressed down;

a back plate that is equipped, under the key top, with a light emitting portion that emits light toward a back surface of the key top;

support members disposed on the back plate and supporting the link mechanism;

a membrane sheet that is placed on top of the back plate and is equipped with contact portions between which an electrical connection is established as a result of the key top being pressed down, the membrane sheet having holes formed therein, the holes allowing the light emitted from the light emitting portion to travel through them, and expose the support members to the back surface of the key top;

an elastic member that is equipped with a pressing portion that causes an electrical connection to be established between the contact portions, the elastic member urging the key top in a direction away from the contact portions;

a first reflection layer that is disposed on the membrane sheet, receives light reflected by the back surface of the key top, and reflects the light past an outer periphery of the key top toward an outer side of the key top; and a frame that has an opening for exposing the key top;

wherein the key top is placed in the opening of the frame such that a space is formed between the frame and the key top; and wherein the light reflected by the first reflection layer travels through the space between the frame and the key top.

2. The key switch structure according to claim 1, wherein the first reflection layer has a first reflection portion that is positioned outside of the outer periphery of the key top when the key top is seen in a plan view.

3. The key switch structure according to claim 2, wherein the first reflection layer has a second reflection portion that is positioned inside of the outer periphery of the key top when the key top is seen in a plan view.

4. The key switch structure according to claim 1, wherein a second reflection layer is disposed on the back surface of the key top.

5. The key switch structure according to claim 1, wherein a reflectance of the first reflection layer is higher than that of the frame.

6. The key switch structure according to claim 1, wherein the first reflection layer is one of an ink layer printed on a front surface of the membrane sheet, a reflection sheet adhered to the membrane sheet, or a reflection sheet disposed on an uppermost layer of the membrane sheet and comprising a plurality of laminated sheets.

* * * * *